United States Patent [19]

Price

[11] Patent Number: 4,949,416

[45] Date of Patent: Aug. 21, 1990

[54] ADHESIVE APPLICATOR DEVICE

[75] Inventor: Frank C. Price, Leicester, England

[73] Assignee: DVSG Patent Verwaltungs GmbH, Frankfurt am Main, Fed. Rep. of Germany

[21] Appl. No.: 329,198

[22] Filed: Mar. 27, 1989

[30] Foreign Application Priority Data

Apr. 22, 1988 [GB] United Kingdom ..... 8809498

[51] Int. Cl.[5] ..... B05C 5/04; B05C 5/02

[52] U.S. Cl. ..... 12/10.5; 12/12; 12/12.4; 118/411

[58] Field of Search ..... 118/411, 412, 205, 410, 118/313, 315; 12/12, 12.1, 12.4, 12.5, 10.1, 10.4, 10.5

[56] References Cited

U.S. PATENT DOCUMENTS 3,807,352 4/1974 Schindler et al. ..... 118/411

3,840,929 10/1974 Garner et al. ..... 118/411

4,283,806 8/1981 Kulik et al. ..... 118/411

4,517,697 5/1985 Vornberger ..... 118/411

*Primary Examiner*—Willard Hoag

[57] ABSTRACT

The device has a continuous adhesive-applying surface which is made up from a plurality of elements, articulated so as to enable the configuration of the surface to be varied by varying the relationship between the elements. More particularly, the elements comprise two base elements pivotally connected to one another and forming the base of the U, and two leg elements one pivotally connected to each of the base elements, forming the legs of the U. For adjusting the configuration of the surface, the distance between the pivotal connections of the leg elements with the base elements and also the distance between the remote ends of the leg elements are adjustable. For use in a pulling over and toe lasting machine, the central pivot between the two base elements is fixed in the machine so as to maintain the toe end of the applicator device in the correct relationship with other operating instrumentalities of the machine.

12 Claims, 3 Drawing Sheets

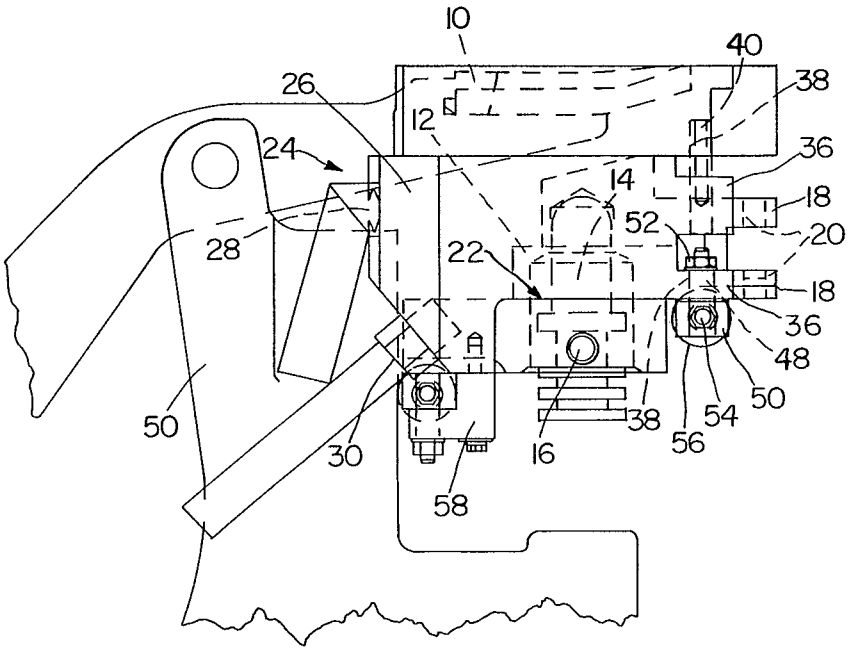
FIG.2
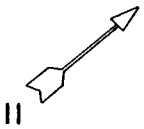

ADHESIVE APPLICATOR DEVICE

BACKGROUND OF THE INVENTION

This invention is concerned with an adhesive applicator device having a continuous surface which is of a generally U-shaped configuration and to which adhesive is supplied and into contact with which the surface of an article to be coated with adhesive can be pressed, wherein the configuration of said surface can be varied by varying the relationship between said elements.

One such device is disclosed in e.g. UK Patent Specification No. 1,454,791, said device being suitable for use in a so-called pulling over and toe lasting machine for use in the manufacture of shoes, in the operation of which machine a shoe upper is pulled over and tensioned about a shoe last, the applicator device is then pressed into contact with the forepart portion of a shoe insole on the bottom of the shoe last, and thereafter, with the device retracted, wiper members are caused to wipe lasting marginal portions of the shoe upper, tensioned as aforesaid, over and press them against corresponding marginal portions of the insole to which the adhesive has been applied as aforesaid.

Said device comprises two elements mounted for relative pivotal movement, about a pivot arranged at or adjacent the "toe" end of the device, under a wedging action. In this way the two elements can be moved to conform to the size of the toe/forepart portion of the shoe to be operated upon. It will, however, be appreciated that the "basic" configuration of the adhesive-applying surface of the device is not altered.

In general the shape of the toe end of a shoe is found to fall into one of three "basic" categories, namely a so-called pointed toe, a so-called square toe and a so-called rounded toe, which shape the configuration of the surface of the adhesive-applying device used should match; desirably also the surface configuration should match the size of the toe end of the insole of the shoe being operated upon. Failure to match the insole configuration will of course mean that the adhesive is applied to the wrong part of the insole.

In practice, therefore, it is usually necessary to provide a pulling over and toe lasting machine with a range of applicator devices in order to be able to accommodate to the various styles and sizes of shoe to be operated upon. It will of course be appreciated that the exchange of an applicator device is time-consuming and tedious, and as a consequence compromises usually have to be reached, which thus act against the optimum application of adhesive for any given style or size.

OBJECT OF THE INVENTION

It is thus the object of the present invention to provide an improved adhesive applicator device, especially, but not exclusively, suitable for use in a pulling over and toe lasting machine, which facilitates the accommodation of the whole range of sizes and styles of shoe to which adhesive is to be applied in a pulling over and toe lasting machine.

SUMMARY OF THE INVENTION

The invention thus provides adhesive applicator device comprising a plurality of elements arranged in a generally U-shaped configuration and providing a continuous surface to which adhesive is supplied and into contact with which the surface of an article to be coated with adhesive can be pressed, wherein the configuration of said surface can be varied by varying the relationship between said elements, said elements comprising two "base" elements, pivotally connected to one another, forming the base of the U, and two "leg" elements, one pivotally connected to each of the "base" elements, forming the "legs" of the U, and wherein, for adjusting the configuration of said surface, the distance between the pivotal connections of the "leg" elements with the "base" elements and also the distance between the remote ends of the "leg" elements are adjustable.

By this arrangement, it will be appreciated, the configuration of the surface can be determined according to the particular style and size of shoe to be operated upon. It will of course be appreciated that, in a pulling over and toe lasting machine in particular, the location of the toe end of the shoe is critical in relation to other component parts of the machine, e.g. the wiper means and also the pincer assembly thereof, and consequently in accordance with the present invention preferably the elements constitute in the device are supported on a support and the pivot about which the "base" elements are pivotally connected is fixed in said support. Thus, in adjusting the distance between the pivotal connections of the "leg" elements with the "base" elements, the device is also moved bodily fore-and-aft of the machine by virtue of the said pivot being fixed. In this way, the device is also located in its proper position lengthwise of the shoe bottom.

For effecting the adjustment of said distances, any suitable means may be provided. Thus, for example, in one embodiment means may be provided for varying the distance between the pivotal connections of the leg elements with the base elements, said means comprising a threaded rod opposite end portions of which have threads of opposite hand, and similar means may be provided for varying the distance between the remote ends of the leg elements. Alternatively, said means may comprise a wedge element acting between appropriate abutment faces provided on the elements. It will of course be appreciated that a combination of wedge arrangement and threaded rod arrangement may be provided.

It will also be appreciated that said varying means may be manually operable or may be motorised. In particular, a motorised version would be especially suitable where the shoe bottom configuration is previously "read" and its shape stored in the form of digitized coordinate axis values. In such an event, the motorised means may include any suitable n.c. motor, e.g. a stepping motor.

In the case of conventional adhesive applicator devices as used in pulling over and toe lasting machines, a single U-shaped element is provided and has one or more melt chambers associated therewith. In the device in accordance with the invention, each leg element has a melt chamber associated therewith, for pivotal adjusting movement therewith, and a connection is then made between the melt chamber and passageways formed within its associated element, said passageways opening into the continuous surface provided by said element.

Furthermore, in the device in accordance with the invention, conveniently the pivotal connections between the leg elements and the base elements include tubular portions through which adhesive supplied from the respective melt chamber can be supplied to passages formed in the respective base element and opening into the surface thereof. In this way, the adhesive from the melt chambers can be supplied along the whole of the continuous surface.

BRIEF DESCRIPTION OF THE DRAWINGS

There now follows a detailed description, to be read with reference to the accompanying drawings, of one adhesive applicator device in accordance with the invention. It will of course be appreciated that this device has been selected for description merely by way of non-limiting example.

In the accompanying drawings:

FIG. 2 is a view in side elevation indicating the manner in which the device is mounted in a pulling over and toe lasting machine.

DESCRIPTION OF THE PREFERRED EMBODIMENT

Figure 1:
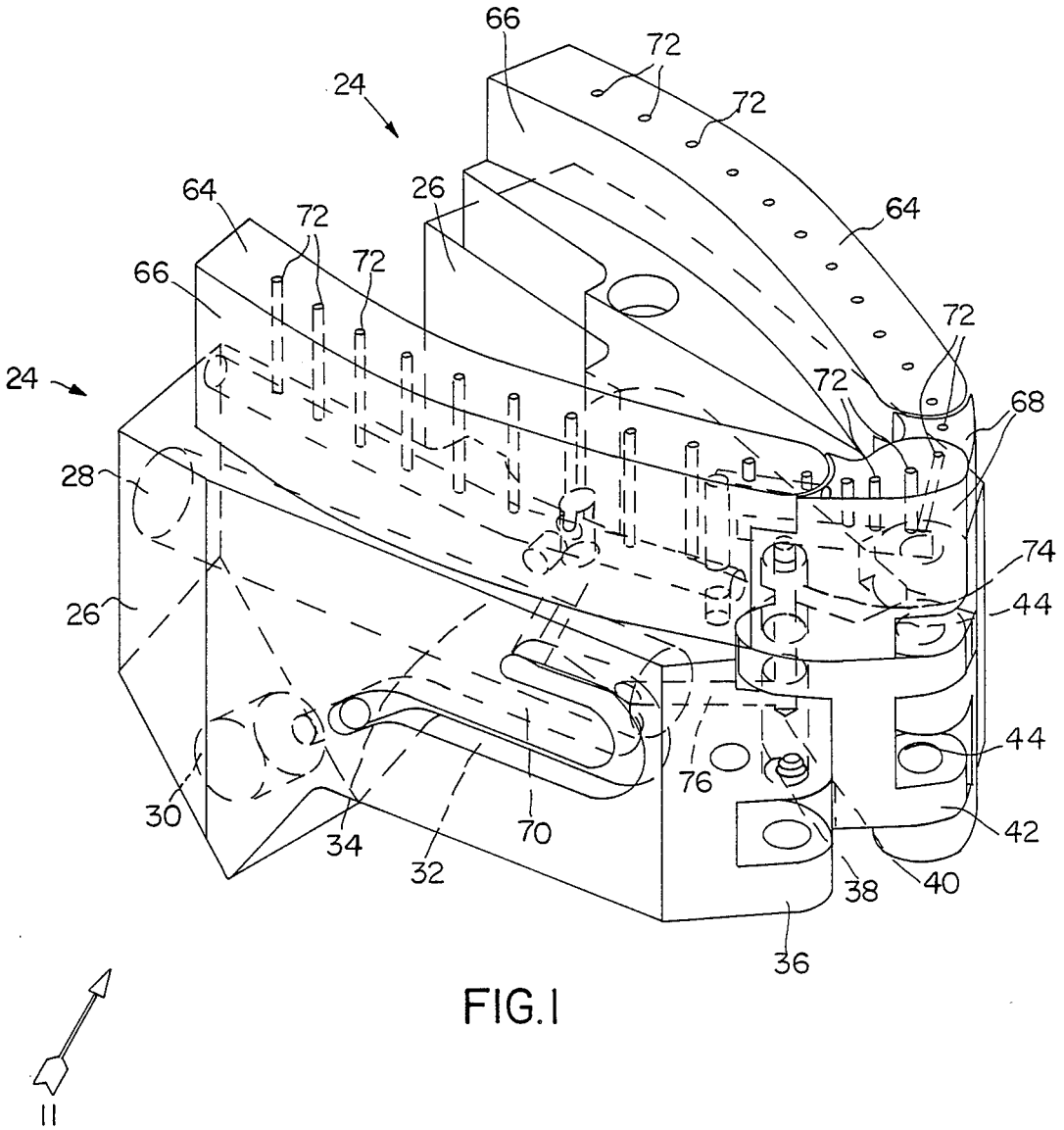
FIG. 1 is a perspective view, showing the various elements of the device and the melt chambers thereof.

The adhesive applicator device now to be described is suitable for use in a pulling over and toe lasting machine e.g. of the type described in U.S. Patent Specification No. 3,840,929. Thus, from the latter specification it can be seen that the machine comprises a shoe support 10 carried by a jack member (not shown, but designated 45 in the aforementioned specification) on which is also supported, for heightwise movement relative thereto, an adhesive applicator device generally designated 11. More particularly, with reference to FIG. 2, the device 11 comprises a block 12 which is provided with an internal recess by which the block can be accommodated at the upper end of a piston rod 14 of a piston-and-cylinder arrangement by which heightwise movement of the device 11 is effected. The block 12 is mounted for limited rocking movement on the piston rod and is held against rotation thereon by screw 16. Towards the toeward end (i.e. right-hand end, viewing FIG. 2), are provided two projecting lug portions 18 having aligned bores 20 formed therein. In addition, the block 12 provides, at each side of the piston rod 14, a supporting surface 22, to be referred to hereinafter.

The device 11 also comprises two melt chambers generally designated 24, each comprising a block 26 in which a heater element 28 is accommodated and which has an inlet 30 through which adhesive in solid rod form can be introduced into the melt chamber. By the heat supplied by heater 28, the adhesive rod is melted and flows along a passageway 32 to an outlet 34.

Figure 3:
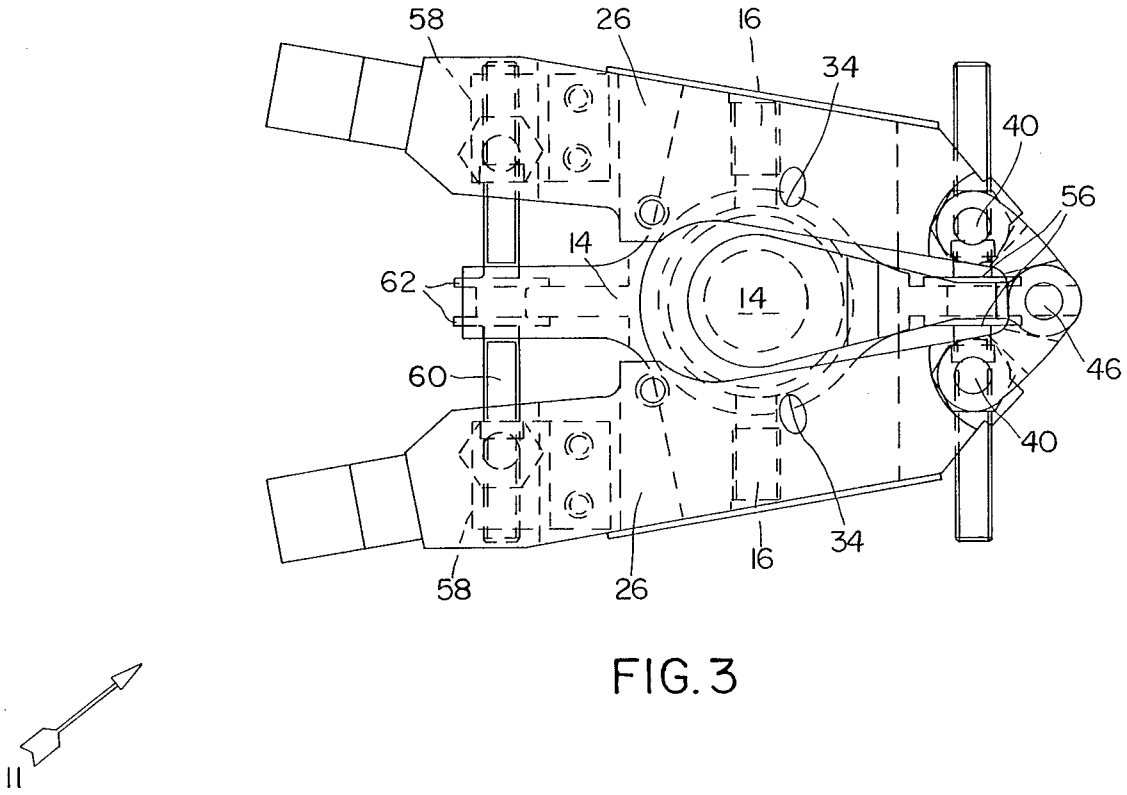
FIG. 3 is a plan view of the device, but with the elements providing the adhesive-applying surface removed to show the arrangment of the melt chambers.

The forward end (i.e. right-hand end, viewing FIG. 2) of each melt chamber has two lug portions 36, again formed with aligned bores 38. In the bore formed in the upper lug portion 36 is supported a pin 40 on which is carried a further support block 42 which is generally kidney-shaped in plan view. The two support blocks 42 are formed with inter-engaging lug portions, respectively at the end thereof remote from the pin 40, and the lug portions are formed with bores 44 which can thus be aligned not only with each other but also with the bores 20 formed in the block !2. By means of a pin 46 (FIG. 3) the support blocks 42 and also, through the pins 40, the melt chambers 24 are thus all supported on the support 12. The support surfaces 22 provided by the block 12 also serve to provide a support for the melt chambers 24.

It will be appreciated that, by virtue of the pivotal connections by means of the pins 40 and 44, the configuration of the various parts described so far can be varied. For effecting such variation, in the bore 38 formed in the lower lug portion 36 of each block 26 is accommodated a pin 48 carrying at its lower end a block 50, which is clamped against the underside of the block 26 by a clamp nut 52 accommodated between the two lug portions 36. The two blocks 50 each threadedly receives one end portion of a threaded rod 54, opposite end portions of which are provided with threads of opposite hand. Thus, by rotating the rod 54, the blocks 50 and thus the forward ends of the blocks 26 are moved towards or away from one another. For facilitating such rotation of the shaft, two rotary wheels 56 are provided centrally of the rod 54, said wheels being spaced from one another and being held against displacement in a direction lengthwise of the rod by a lug 58 formed on the underside of the forwardly projecting portion of the block 12.

It will be appreciated that, by rotating the wheels 56, the pins 40 are moved towards or away from one another so that the forward ends of the melt chambers 24 are similarly moved. Since, however, the pin 46 is fixed in the support block 12, the effect of such adjustment is to move the melt chambers also bodily in a direction lengthwise of the device.

Similar adjusting means is provided for varying the distance between the ends of the melt chambers 24 remote from the pin 46 and to this end there is mounted on the underside of the block 26 of each melt chamber a further support block 58, and a further rod 60 having opposite-handed threaded end portions is carried by the two blocks, said rod being provided with a pair of centrally disposed rotary wheels 62 spaced apart and held captive, against transverse movement, by a depending lug formed on the block 12. Whereas in the device now being described, the adjustment of these various distances is achieve manually by means of rotation of the rods 54, 60, it will be appreciated that such rotation could be motorised, e.g. by a stepping motor or other n.c. motor; alternatively instead of threaded rods as above described, wedge arrangements could be utilised.

For applying the adhesive which has been melted in the melt chambers as aforesaid, a continuous adhesive applying surface 64 is provided by means of a plurality (in casu 4) elements 66, 68, supported by the blocks 26 and support blocks 42 as will now be described. Each element 66, which constitutes a "leg" element of the generally U-shaped configuration of the continuous surface 64, is secured by screws (not shown) to the upper surface of its associated block 26, such that an inlet passage 70 thereof coincides with the outlet 34 of the block 26. The inlet 70 is connected through internal passages formed in the element 66 to outlets 72 which open into the continuous surface 64. The elements 68 are formed with inter-engaging lug portions (see especially Figs. 1 and 3) and bores, one of which is blind, aligned with the bores 44 of the support block 42, for receiving an upper end portion of the pin 46, and each element 68 and its adjacent element 66 are also formed with inter-engaging lug portions having bores, one (74) of which is blind, aligned with the bores 38, for receiving the upper end portion of the respective pin 40.

As will be seen most clearly from FIG. 1, adhesive is supplied to each element 68 from the melt chamber 24 associated with its associated element 66. To this end, the passage 32 formed in the block 26 has branch 76 which is connected to a passage formed in the pin 40, which is thus tubular. The upper end of the pin 40 opens into the blind bore 74 into which also opens an internal passageway 78 formed in the element 68 and itself opening through outlet 72 into the continuous surface 64.

In this way, adhesive is supplied through all of the outlets 72 to ensure an adequate supply to the continuous surface 64.

I claim:

1. An adhesive applicator device for use in a machine for lasting toe and forepart regions of shoes, said device providing a generally U-shaped surface to which adhesive is supplied and into contact with which the toe and forepart regions of a shoe bottom can be pressed for the application of adhesive thereto, said device comprising:

a pair of base elements pivotably connected to each other in a position corresponding to the toe region of a shoe and forming the base of the "U", said elements forming the mechanism whereby adhesive can be applied as aforesaid to the toe region of a shoe bottom that is pressed thereagainst;

two leg elements, one pivotably connected to each of the base elements in a position corresponding to the toe region of a shoe, said leg elements forming the legs of the "U", said elements forming the mechanism whereby adhesive can be applied as aforesaid to the forepart regions of the shoe bottom that is pressed thereagainst; and means for adjusting the configuration of said surface according to the style of shoe to which adhesive is to be applied by adjusting the distance between the pivotal connections between the leg elements and the base elements said means for adjusting being positioned adjacent said base elements whereby to vary the configuration of the toe end of the device and also to vary the distance between the remote ends of the leg elements according to the shape of the shoe bottom.

2. Device according to claim 1 wherein the elements are supported on a support, and wherein the pivot about which the "base" elements are pivotally connected is fixed in said support.

3. Device according to claim 2 wherein each leg element has a melt chamber associated therewith, for pivotal adjusting movement therewith.

4. Device according to claim 3 wherein the pivotal connection between the "leg" elements and the "base" elements include tubular portions through which adhesive supplied from the respective melt chamber can be supplied to passages formed in the respective "base" element and opening into the surface thereof.

5. Device according to claim 1 wherein means, comprising a threaded rod opposite end portions of which have threads of opposite hand, is provided for varying the distance between the pivotal connections of the "leg" elements with the "base" elements and also wherein means, comprising a threaded rod opposite end portions of which have threads of opposite hand, is provided for varying the distance between the remote ends of the "leg" elements.

6. Device according to claim 5 wherein each leg element has a melt chamber associated therewith, for pivotal adjusting movement therewith, and also wherein the pivotal connection between the "leg" elements and the "base" elements include tubular portions through which adhesive supplied from the respective melt chamber can be supplied to passages formed in the respective "base" element and opening into the surface thereof.

7. Device according to claim 1 wherein earn leg element has a melt chamber associated therewith, for pivotal adjusting movement therewith.

8. Device according to claim 7 wherein the pivotal connection between the "leg" elements and the "base" elements include tubular portions through which adhesive supplied from the respective melt chamber can be supplied to passages formed in the respective "base" element and opening into the surface thereof.

9. Device according to claim 2 wherein means, comprising a threaded rod opposite end portions of which have threads of opposite hand, is provided for varying the distance between the pivotal connections of the "leg" elements with the "base" elements.

10. Device according to claim 9 wherein means, comprising a threaded rod opposite end portions of which have threads of opposite hand, is provided for varying the distance between the remote ends of the "leg" elements.

11. Device according to claim 10 wherein each leg element has a melt chamber associated therewith, for pivotal adjusting movement therewith.

12. Device according to claim 11 wherein the pivotal connection between the "leg" elements and the "base" elements include tubular portions through which adhesive supplied from the respective melt chamber can be supplied to passages formed in the respective "base" element and opening into the surface thereof.

* * * * *